US006337608B1

(12) United States Patent
McLean et al.

(10) Patent No.: US 6,337,608 B1
(45) Date of Patent: Jan. 8, 2002

(54) FORMATION OF A TRANSMISSION-LINE TRANSFORMER PROVIDING A FREQUENCY-DEPENDENT IMPEDANCE TRANSFORMATION RATIO

(75) Inventors: James Stuart McLean; Gentry Elizabeth Crook, both of Austin, TX (US)

(73) Assignee: TDK RF Solutions, Inc., Austin, TX (US)

( * ) Notice: Subject to any disclaimer, the term of this patent is extended or adjusted under 35 U.S.C. 154(b) by 0 days.

(21) Appl. No.: 09/401,630

(22) Filed: Sep. 22, 1999

Related U.S. Application Data

(60) Provisional application No. 60/101,283, filed on Sep. 22, 1998.

(51) Int. Cl.[7] ..... H01P 5/10

(52) U.S. Cl. ..... 333/35; 333/32; 333/26; 336/182

(58) Field of Search ..... 333/25, 26, 32–35; 336/182, 184, 186

(56) References Cited

U.S. PATENT DOCUMENTS 5,767,754 A * 6/1998 Menna ..... 333/25
5,808,518 A * 9/1998 McKinzie, III et al. ..... 333/26

* cited by examiner

*Primary Examiner*—Benny Lee
*Assistant Examiner*—Stephen E. Jones
(74) *Attorney, Agent, or Firm*—Darby & Darby

(57) ABSTRACT

A transformer for connection between a generator and a load may be formed by connecting n transmission lines together, in series at one end and in parallel at the other end. The transmission lines are configured to each have a characteristic impedance of $\sqrt{R_G|Z_L(f_0)|}$, where $f_0$ is the frequency at which each transmission line is one quarter of a wavelength long (quarter-wavelength frequency), $|Z_L(f_0)|$ is the magnitude of the load impedance at the quarter-wavelength frequency, and $R_G$ is the generator resistance. The transformer exhibits a frequency-dependent impedance transformation ratio, allowing a more efficient impedance match of a generator to a load having a frequency-dependent impedance, such as an antenna.

16 Claims, 4 Drawing Sheets

FORMATION OF A TRANSMISSION-LINE TRANSFORMER PROVIDING A FREQUENCY-DEPENDENT IMPEDANCE TRANSFORMATION RATIO

RELATED APPLICATIONS

This application claims the benefit of U.S. Provisional Patent Application No. 60/101,283, filed on Sep. 22, 1998.

BACKGROUND OF THE INVENTION

1. Field of the Invention

The present invention relates generally to the field of impedance matching and more specifically to the broadband impedance matching of antennas and other frequency-dependent loads.

2. Description of the Related Art

The descriptions and examples included herein are not admitted to be prior art by virtue of their inclusion in this section.

Broadband transformers including BALUNs (BALanced to UNbalanced transformers) and UNUNs (UNbalanced-to-UNbalanced transformers) are often implemented using a transmission line design. The much-preferred design has become known as the Guanella transformer. Such a transformer consists of a set of n uniform transmission lines with characteristic impedance $Z_0$, wavenumber β, and length l, connected in parallel at one end and series at the other. The so-called common mode of the transmission lines is then choked off using any one of several methods. Thus the input impedance at the parallel-connected end of the transformer is:

$$Z_{in} = \frac{Z_0}{n}\left(\frac{\frac{Z_L}{n} + jZ_0\tan(\beta l)}{Z_0 + \frac{jZ_L}{n}\tan(\beta l)}\right) \tag{1}$$

If the characteristic impedance of the transmission lines is chosen to be $Z_L/n$ then $$Z_{in} = \frac{Z_L}{n^2} \tag{2}$$

for all frequencies.

This provides for a very broadband $n^2$:1 impedance transformation. Such transformers are widely used in broadband amplifiers, fast pulse applications, and occasionally with broadband antenna systems.

This broadband constant transformation is primarily useful for matching a resistive generator to a resistive load when both generator and load resistances are constant with frequency. For example, a traditional Guanella transformer can be used to match a 50 Ohm resistive generator to a 200 Ohm resistive load. However, when matching a resistive generator to a frequency-dependent load such as an antenna, having a transformation ratio which is constant with frequency is not always advantageous. Resonant antennas exhibit frequency-dependent input impedances which cycle though alternating series and parallel type resonances with increasing frequency.

It would therefore be desirable to develop a transformer which provides a more accurate impedance match with frequency to a load having a frequency-dependent impedance.

SUMMARY OF THE INVENTION

The problems described above are addressed at least in part by a transformer combining the desirable features of the quarter-wave transformer and the Guanella transformer. This design can provide an impedance transformation ratio which varies with frequency, f, in a desirable manner.

The utility of a frequency dependent impedance transformation ratio becomes apparent by examination of the problem of obtaining maximum power transfer between a resistive source with resistance $R_G$ and a complex, frequency-dependent load with impedance $Z_L(f)$ when matching is limited to a real impedance transformation; that is, no reactance or suseptance cancellation is employed. In this case, the optimum transformed source resistance is $$R_{opt} = |Z_L|. \tag{3}$$

Thus it is desirable to transform the source resistance to be equal to the magnitude of the complex load impedance or, alternatively, transform the complex load impedance so that its magnitude equals the source resistance. Thus, when the magnitude of the complex load impedance varies with frequency and the source impedance is a constant resistive value (as is generally the case), it is useful to have a frequency-dependent impedance transformation ratio, ρ, equal to the ratio of the magnitude of the complex load impedance to the generator (source) resistance.

$$\rho = \frac{|Z_L|}{R_G} \tag{4}$$

The transformer consists of n transmission lines connected in series at one end and in parallel at the other. The transmission lines are commensurate in length and are a quarter wave long at a particular frequency, $f_0$. The common mode of the transmission lines is choked off using one of several techniques such as coiling the transmission lines, wrapping them around a high-permeability core, threading them through high-permeability choke beads, or any of several other methods of increasing the common-mode inductance.

In general the input impedance to such a device, $Z_{in}(f)$, when connected to a load $Z_L(f)$ is $$Z_{in}(f) = \frac{Z_0}{n}\left(\frac{\frac{Z_L(f)}{n} + jZ_0\tan(\beta l)}{Z_0 + \frac{jZ_L(f)}{n}\tan(\beta l)}\right). \tag{5}$$

At low frequencies, where the electrical length of the lines is negligible), ($\beta l \ll \pi/2$), $$Z_{in}(f) = \frac{Z_L(f)}{n^2} \tag{6}$$

and the transformer acts as a conventional Guanella transformer thus providing an $n^2$:1 impedance transformation ratio. This impedance transformation is provided essentially independently of the characteristic impedance of the transmission lines and is maintained as long as the electrical length of the transmission lines is short.

On the other hand, when the length of the transmission lines is approximately one-quarter of a wavelength ($\beta \approx \pi/2$), the transmission lines become impedance inverters and $$Z_{in} \approx \frac{Z_0^2}{Z_L}. \quad (7)$$

The input impedance is now independent of n and is determined entirely by $Z_0$ and $Z_L$.

Thus, the characteristic impedance of the lines can be chosen such that for frequencies in the vicinity of the quarter-wave frequency, the transformer acts as a quarter-wave transformer. That is, the characteristic impedance of the lines is chosen to be $$Z_0 \approx \sqrt{R_G |Z_L(f_0)|}. \quad (8)$$

where is $f_0$ is the frequency at which the lines are one-quarter wavelength long. Thus, the new transformer design combines the characteristics of the Guanella transformer with those of the quarter-wave transformer to give a frequency-dependent transformation ratio. Therefore, it will be referred to as a frequency-dependent transmission line transformer.

DETAILED DESCRIPTION OF THE PREFERRED EMBODIMENTS

Figure 1:
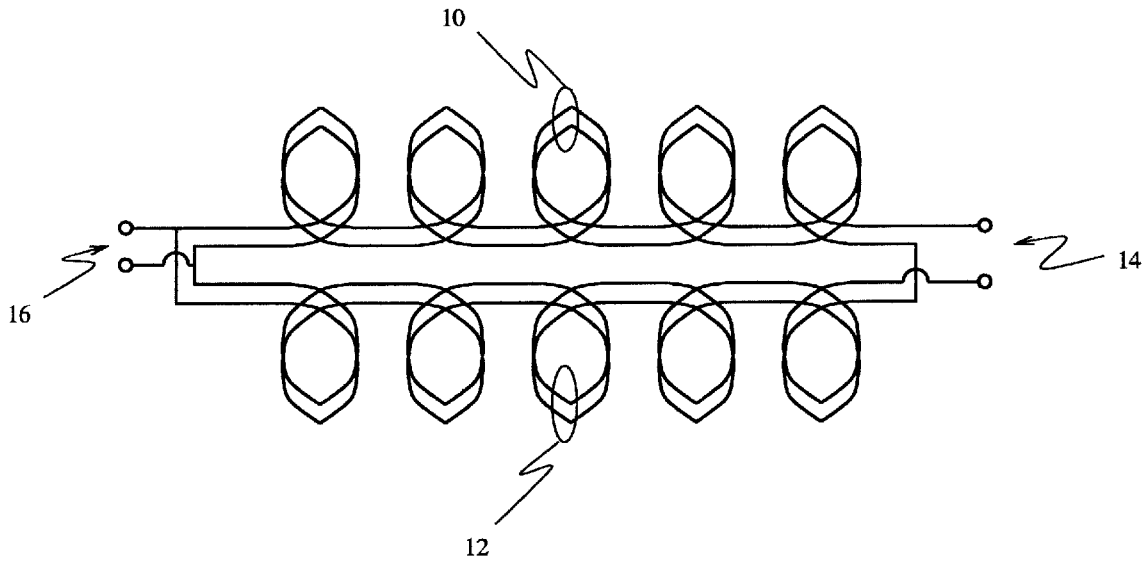
FIG. 1 Schematic diagram of a two-line (n=2) frequency-dependent transmission line transformer.
Figure 2:
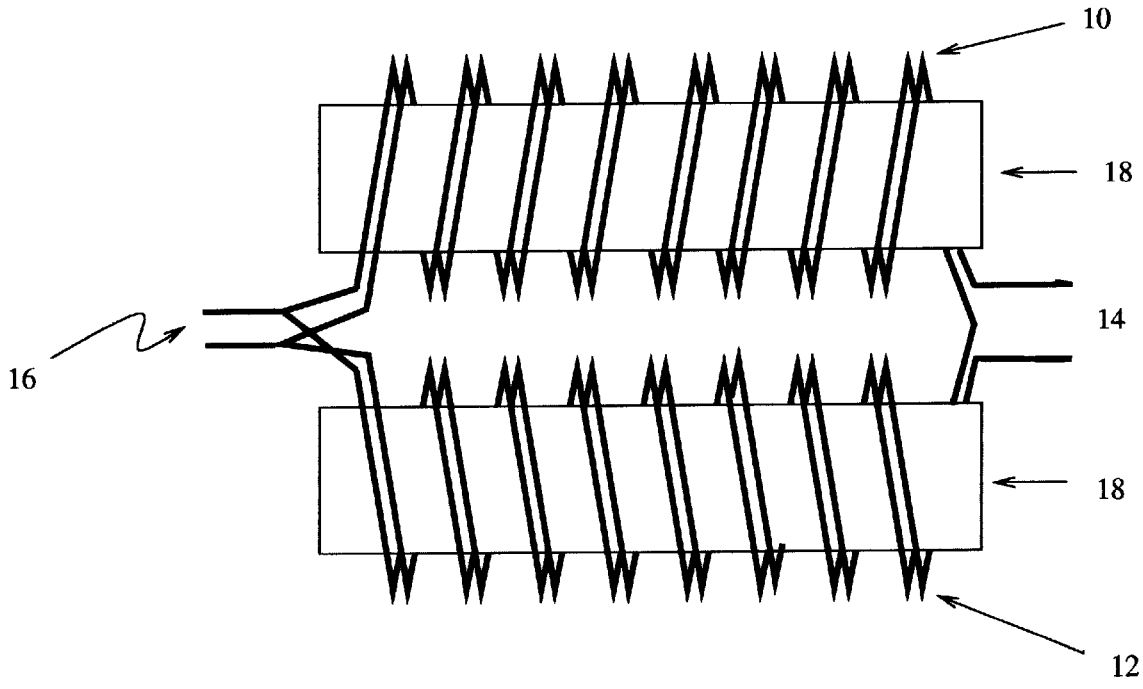
FIG. 2 Frequency-dependent transmission line transformer wound on ferrite rod core.
Figure 3:
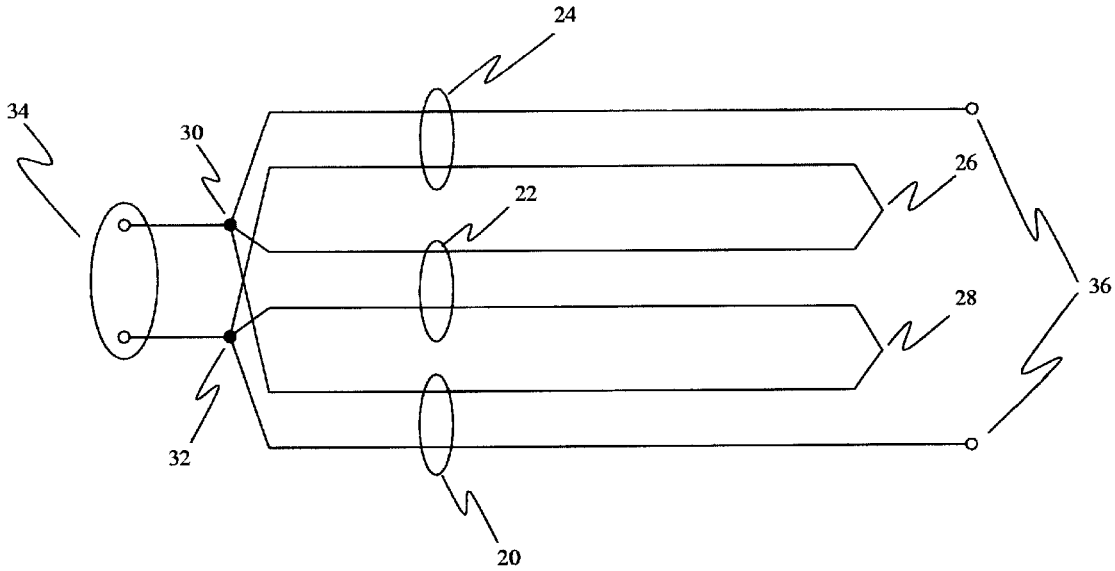
FIG. 3 Illustration of series and parallel connections for transformer with n=3.

In one embodiment, the frequency-dependent transmission line transformer consists of two bifilar transmission lines 10 and 12 connected with series connection 14 at one end and parallel connection 16 at the other, as shown schematically in FIG. 1. The lines are of commensurate electrical length and equal characteristic impedance. This length and the characteristic impedance are chosen so that at the quarter-wave frequency of the line, the transformer behaves as a quarter-wave matching transformer. This is to be contrasted with the conventional Guanella transformer in which the characteristic impedance of the transmission line is chosen to be $Z_L/n$. In FIG. 2, a pictorial representation of the same transformer is shown in which each of the transmission lines is coiled around a ferrite or iron powder core 18 in order to choke off the common mode. Details of the series and parallel connections for a transformer with n=3 are shown in FIG. 3 to further illustrate the nature of these connections. Coiling of transmission lines 20, 22, and 24 (or other common-mode rejection techniques) is omitted for clarity, connection 26 connects transmission lines 24 and 22 in series, while connection 28 does the same for lines 22 and 20. Terminals 36, across which a load or generator may be connected, complete the series connection. "Series connection, or "in series", as used herein refer to this type of series connection, which is widely practiced for connecting two-port networks, such as transmission lines, in series. The parallel connection at the other end of lines 20, 22 and 24 includes connection 30 which connects the upper wires of the lines in parallel and connection 32 which does the same for the lower wires. A generator or load may be connected to terminals 34 of the parallel connection.

Figure 4:
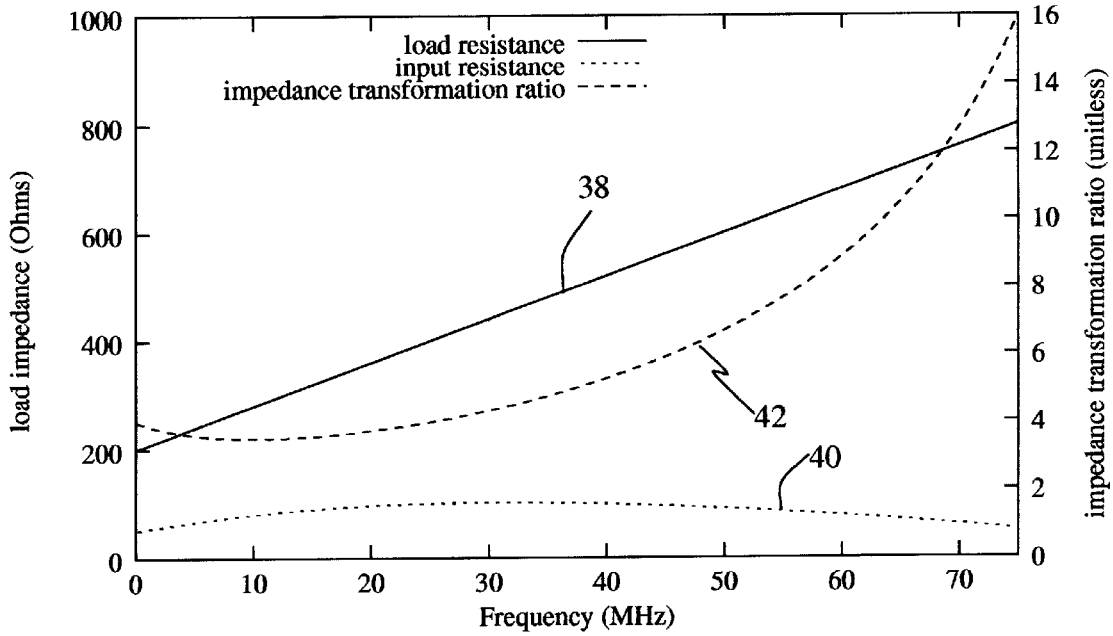
FIG. 4 Frequency dependence of transforming action of frequency-dependent transmission line transformer when connected to a frequency-dependent load.
Figure 5:
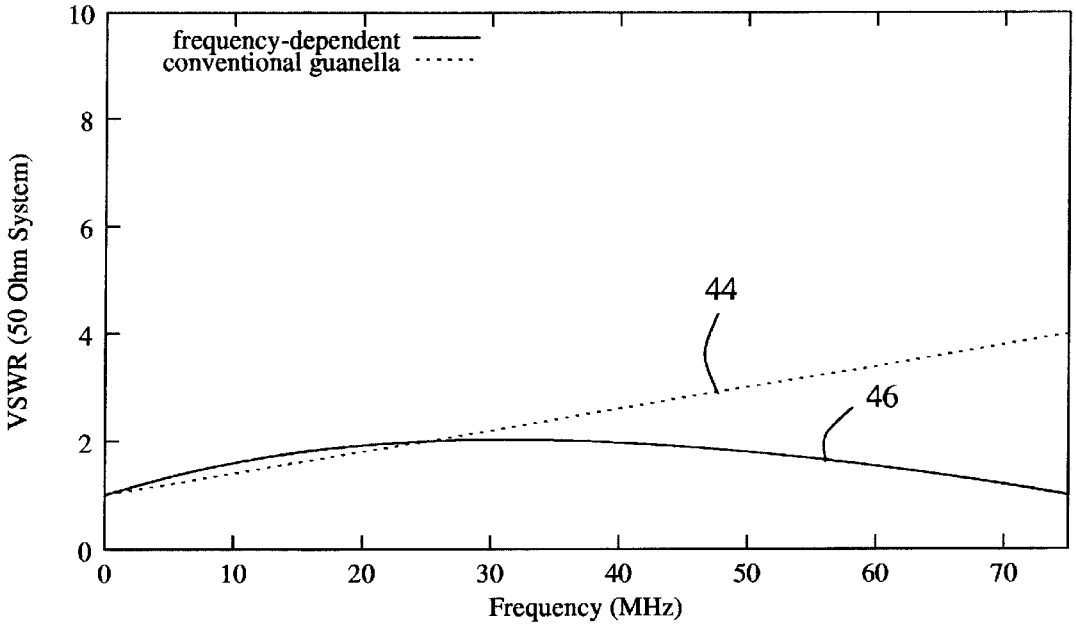
FIG. 5 Calculated standing wave ratio when a 50 Ohm resistive source is connected to the frequency dependent load in FIG. 4 via a conventional Guanella transformer and the frequency-dependent transmission line transformer. Data shows improvement (reduced VSWR) provided by new design.
Figure 6:
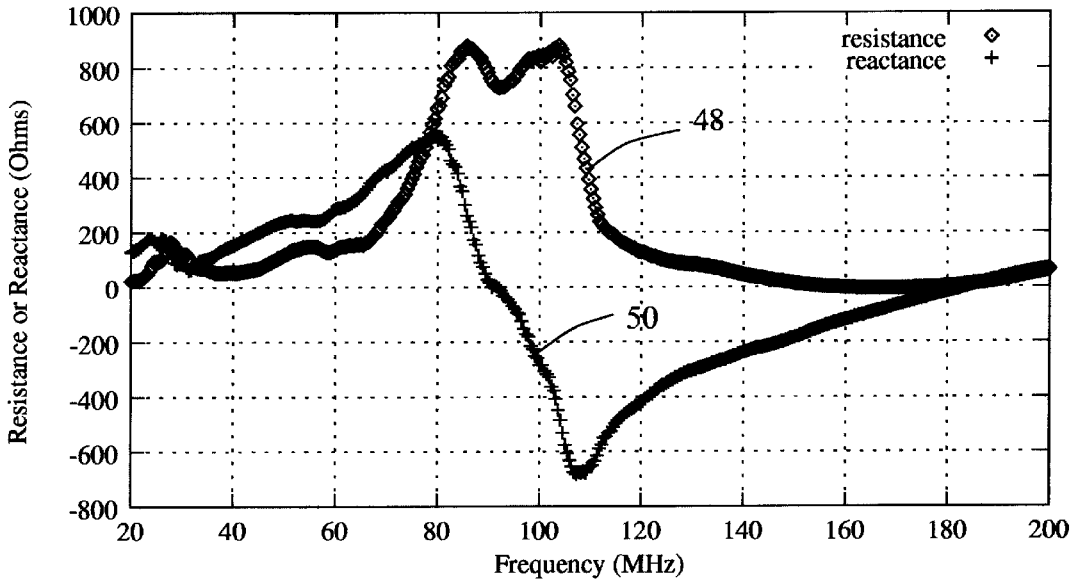
FIG. 6 Measured complex input impedance of a particular antenna showing frequency dependence of resistance and reactance.
Figure 7:
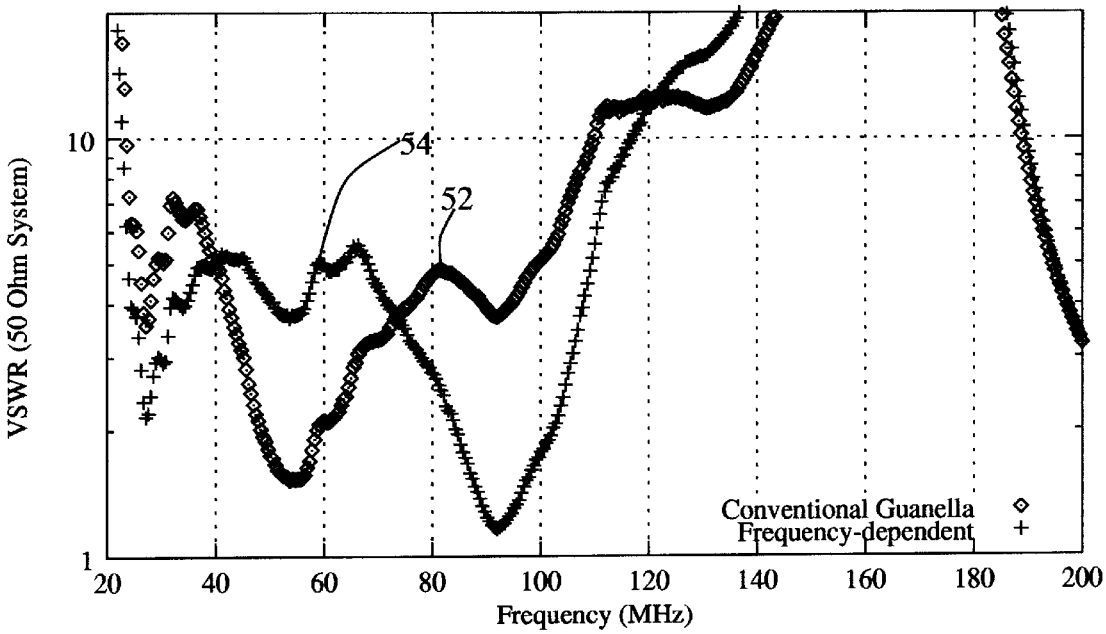
FIG. 7 Calculated standing wave ratio when a 50 Ohm resistive source is connected to the frequency dependent load in FIG. 6 via a conventional Guanella transformer and the frequency-dependent transmission line transformer. Data shows improvement (reduced VSWR) provided by new design.

In FIG. 4, a frequency-dependent load resistance (curve 38) is shown along with the calculated resultant input impedance (curve 40) obtained using a frequency-dependent transmission line transformer. This relatively constant input impedance with frequency is obtained because the impedance transformation ratio ρ (calculated curve 42) varies with frequency. In FIG. 5, the calculated resultant input standing wave ratio is shown when the load is connected to a 50 Ohm resistive source through a conventional Guanella transformer (curve 44) and a frequency-dependent transmission line transformer (curve 46). As can be seen, the VSWR is lower when the frequency dependent transmission line transformer is employed. Finally, the measured complex input impedance of a particular antenna is shown in FIG. 6 showing the frequency dependence of the resistance (curve 48) and the reactance (curve 50). In FIG. 7, the resultant input standing wave ratio is shown when the antenna is connected to a 50 Ohm resistive source through a conventional Guanella transformer (curve 52) and a frequency-dependent transmission line transformer (curve 54). Again the average VSWR is lower when the frequency dependent transmission line transformer is employed, at least for frequencies up to about 120 MHz.

The transformers disclosed herein can be made and used without undue experimentation in light of the present disclosure. While the method and transformers have been described in terms of preferred embodiments, it will be apparent to those skilled in the relevant art that variations may be applied to the method and structures described herein without departing from the concept, spirit and scope of the invention.

What is claimed is:

1. A method for forming a transformer to connect between a generator and a load, comprising:

connecting first ends of n transmission lines together in series, wherein n is a positive integer; and connecting the remaining ends of the n transmission lines together in parallel;

wherein each of the n transmission lines is configured to have a characteristic impedance approximately equal to a square root of a product of a resistance of the generator and a quarter-wave impedance of the load and the characteristic impedance is not equal to the quarter-wave impedance of the load divided by n, wherein the quarter-wave impedance of the load is defined at a frequency for which each of the n transmission lines is one quarter of a wavelength long.

2. The method as recited in claim 1, wherein n is approximately equal to the square root of a quotient of a low-frequency impedance of the load and the generator resistance, wherein the low-frequency impedance of the load comprises an impedance of the load at approximately a lowest operation frequency of the load.

3. The method as recited in claim 1, wherein each of the n transmission lines is formed into a coil.

4. The method as recited in claim 3, wherein each of the transmission lines is coiled around a high-permeability core.

5. The method as recited in claim 1, wherein a low-frequency impedance of the load is defined at at least one frequency for which a product of a wave number and length of each of the n transmission lines is negligible compared to $\Pi/2$ and wherein the characteristic impedance of each of the n transmission lines is not equal to a square root of a product of the resistance of the generator and the low-frequency impedance of the load.

6. The method as recited in claim 1, wherein a low-frequency impedance of the load is defined at at least one frequency for which a product of a wave number and length of each of the n transmission lines is less than $\Pi/2$ and wherein the characteristic impedance of each of the n transmission lines is not equal to a square root of a product of the resistance of the generator and the low-frequency impedance of the load.

7. The method recited in claim 1 wherein an impedance transformation ratio of the transformer varies with frequency.

8. A transformer for connecting between a generator and a load, comprising n transmission lines having first ends connected together in series and remaining ends connected in parallel, wherein n is a positive integer, and wherein each of the transmission lines has a characteristic impedance approximately equal to a square root of a product of a resistance of the generator and a quarter-wave impedance of the load and the characteristic impedance is not equal to the quarter-wave impedance of the load divided by n, wherein the quarter-wave impedance of the load is defined at a frequency for which each of the n transmission lines is one quarter of a wavelength long.

9. The transformer as recited in claim 8, wherein n is approximately equal to the square root of a quotient of a low-frequency impedance of the load and the generator resistance, wherein the low-frequency impedance of the load comprises an impedance of the load at approximately a lowest operation frequency of the load.

10. The transformer as recited in claim 8, wherein each of the n transmission lines is formed into a coil.

11. The transformer as recited in claim 8, wherein each of the transmission lines is coiled around a high-permeability core.

12. The transformer as recited in claim 8, wherein a low-frequency impedance of the load is defined at at least one frequency for which a product of a wave number and length of each of the n transmission lines is negligible compared to $\Pi/2$ and wherein the characteristic impedance of each of the n transmission lines is not equal to a square root of a product of the resistance of the generator and the low-frequency impedance of the load.

13. The transformer as recited in claim 8, wherein a low-frequency impedance of the load is defined at at least one frequency for which a product of a wave number and length of each of the n transmission lines is less than $\Pi/2$ and wherein the characteristic impedance of each of the n transmission lines is not equal to a square root of a product of the resistance of the generator and the low-frequency impedance of the load.

14. The transformer recited in claim 8 wherein an impedance transformation ratio of the transformer varies with frequency.

15. A method for forming a transformer to connect between a generator and a frequency-dependent load, comprising:

connecting first ends of n transmission lines together in series, wherein n is a positive integer; and connecting the remaining ends of the n transmission lines together in parallel;

wherein each of the n transmission lines is configured to have a characteristic impedance approximately equal to a square root of a product of a resistance of the generator and a quarter-wave impedance of the frequency-dependent load, wherein the quarter-wave impedance of the frequency-dependent load is defined at a frequency for which each of the n transmission lines is one quarter of a wavelength long.

16. A transformer for connecting between a generator and a frequency-dependent load, comprising n transmission lines having first ends connected together in series and remaining ends connected together in parallel, wherein n is a positive integer, and wherein each of the transmission lines has a characteristic impedance approximately equal to a square root of a product of a resistance of the generator and a quarter-wave impedance of the frequency-dependent load, wherein the quarter-wave impedance of the frequency-dependent load is defined at a frequency for which each of the n transmission lines is one quarter of a wavelength long.

* * * * *